United States Patent [19]

Urayama

[11] 4,451,005

[45] May 29, 1984

[54] GAS FLOW TYPE CRUSHING AND CLASSIFYING APPARATUS

[75] Inventor: Kiyoshi Urayama, Yahata, Japan

[73] Assignee: Kabushiki Kaisha Hosakawa Funtai Kogaku Kenkyosho, Osaka, Japan

[21] Appl. No.: 545,101

[22] Filed: Oct. 21, 1983

Related U.S. Application Data

[63] Continuation of Ser. No. 320,375, Nov. 12, 1981, abandoned.

[30] Foreign Application Priority Data

| | | | |
|---|---|---|---|
| Nov. 13, 1980 | [JP] | Japan | 55-160497 |
| Feb. 14, 1981 | [JP] | Japan | 56-20457 |
| May 20, 1981 | [JP] | Japan | 56-77238 |

[51] Int. Cl.[3] ..... B02C 19/06

[52] U.S. Cl. ..... 241/40; 241/79.1; 241/80; 241/152 R

[58] Field of Search ..... 241/5, 39, 40, 79.1, 241/80, 152 R, 152 A

[56] References Cited

U.S. PATENT DOCUMENTS

| | | | |
|---|---|---|---|
| 1,753,437 | 4/1930 | Lykken | 241/5 |
| 2,562,753 | 7/1951 | Trost | 241/5 X |
| 3,312,342 | 4/1967 | Brown | 241/40 X |
| 3,741,485 | 6/1973 | Gage et al. | 241/5 X |
| 3,815,833 | 6/1974 | Vliet et al. | 241/5 |
| 4,248,387 | 2/1981 | Andrews | 241/5 |
| 4,304,360 | 12/1981 | Luhr et al. | 241/80 X |

*Primary Examiner*—Mark Rosenbaum

*Attorney, Agent, or Firm*—Edwin E. Greigg

[57] ABSTRACT

A circulation classifying chamber having a coarse particle discharge duct connected to a peripheral position thereof and a fine particle discharge duct connected thereto about an axis of circulation, is provided with a baffle member, a nozzle and, as necessary, a rectifier. Particulate materials jetting out of the nozzle on high velocity gas flows violently collide with the baffle member to be crushed and given components of velocity in a direction of flow in the circulation classifying chamber. Thus, crushing and classification proceed in parallel.

7 Claims, 12 Drawing Figures

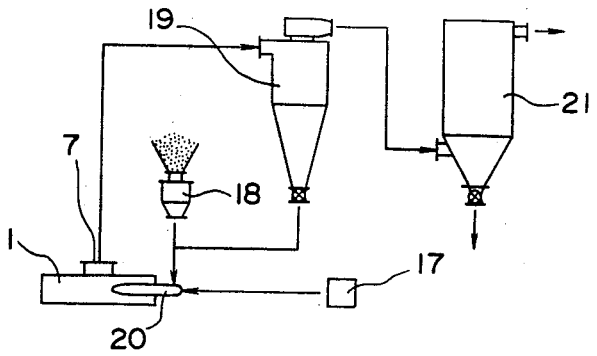
Fig. 1
Fig. 2
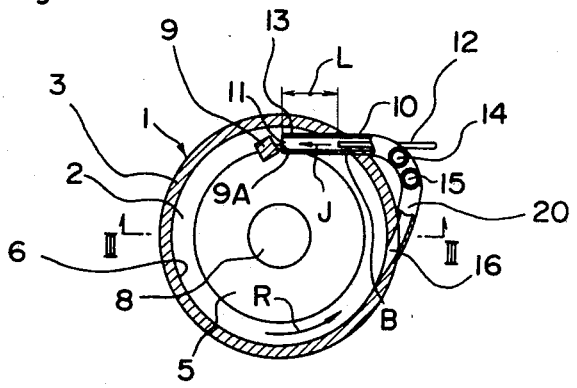
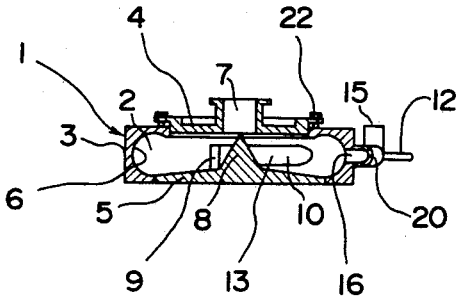
Fig. 3

GAS FLOW TYPE CRUSHING AND CLASSIFYING APPARATUS

This is a continuation of copending application Ser. No. 320,375 filed Nov. 12, 1981, now abandoned.

BACKGROUND OF THE INVENTION (1) Field of the Invention

The present invention relates to a gas flow type crushing and classifying apparatus adapted to crush material and at the same time classify crushed pieces of the material by using gas flows within a circulation classifying chamber. (2) Description of the Prior Art A crushing machine for crushing particulate materials by utilizing fluid energy is known and used to produce hyperfine pieces. On the other hand, such a machine is well known to have low crushing efficiency relative to the power required, and it has been a problem how to improve its crushing efficiency. Therefore, in order to obtain a desired amount of product, a crushing apparatus tended to be of extremely large size to compensate for the low crushing efficiency of the crushing machine and to permit the crushing machine to be connected to a classifying machine.

SUMMARY OF THE INVENTION

An object of the present invention is to provide a high efficiency crushing apparatus, particularly a crushing and classifying apparatus, to achieve the compactness of the apparatus and reduction in the operating costs thereof.

Another object of the present invention is to provide a gas flow type crushing and classifying apparatus including a circulation classifying chamber having a coarse particle discharge duct connected to a peripheral position thereof and a fine particle discharge duct connected to be coaxial therewith, and baffle means disposed in the circulation chamber.

Still another object of the present invention is to provide a gas flow type crushing and classifying apparatus including baffle means constructed and disposed in the circulation classifying chamber such that particulate materials jetted out of a jet nozzle on high velocity gas flows collide with the baffle means to be crushed and part of the crushed materials rebounding from the baffle means are given components of velocity in the direction of flow within the circulation classifying chamber.

The present invention achieves compactness of the apparatus per se by suitably disposing the baffle means to realize effective crushing function. Furthermore, the present invention has great advantages of reducing the operating costs and the manufacturing costs of the apparatus which result from the improved crushing efficiency and the compactness of the apparatus.

Other objects and advantages of the present invention will be apparent from the following detailed description with reference to the accompanying drawings.

BRIEF DESCRIPTION OF THE DRAWINGS

FIG. 1 is a schematic view of a first embodiment of the present invention,

FIG. 2 is a sectional view of the principal portion of an apparatus according to the first embodiment, FIG. 3 is a sectional view taken on line III—III of FIG. 2.

DETAILED DESCRIPTION OF THE PREFERRED EMBODIMENTS

Figure 4:
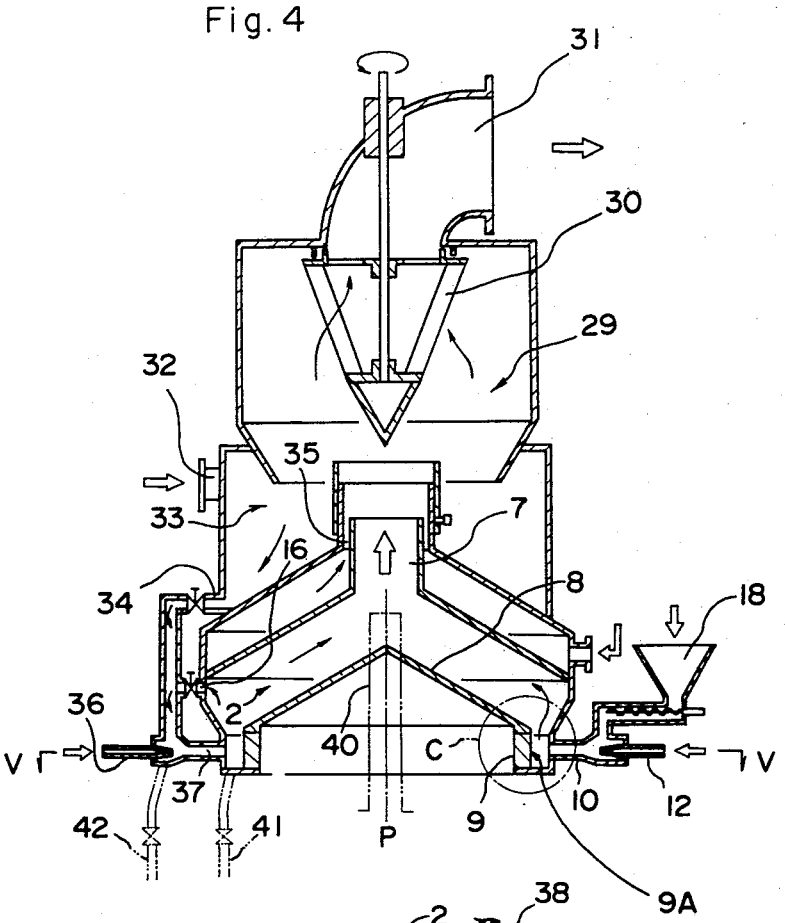
FIG. 4 is a sectional view of a second embodiment of the present invention.

Referring to the embodiment of FIGS. 1–3, a crushing and classifying apparatus 1 is connected with a secondary classifying apparatus 19 and a collector 21. The crushing and classifying apparatus 1 comprises a circulation classifying chamber 2 defined by a casing having an upper disc plate 4, a lower disc plate 5 and a peripheral wall with an inner wall surface 6 of hemispherical or U-shaped section. The upper disc plate 4 includes a fine particle discharge duct 7 at a central top portion thereof, and the lower disc plate 5 includes an upwardly projecting conical guide member 8 at a central portion thereof. A jet nozzle 10 extends through the peripheral wall into the circulation classifying chamber 2 in a direction slightly inclined toward the center of the chamber 2 from the tangent of the inner wall surface 6, and a baffle member 9 is disposed in the chamber 2 at a small spacing from an outlet opening 11 of the jet nozzle 10. The baffle member 9 has an impingement surface 9A opposed to the outlet 11 of the nozzle 10, the impingement surface 9A being heat treated or coated with a super-hard material to have high wear resistance. The surface 9A is somewhat inclined outwardly and suitably spaced from the inner wall surface 6. The baffle member 9 may be of varied shapes and materials, and it is also possible to arrange that the surfaces of the baffle member 9 of a polygonal configuration face the jet nozzle 10 by turns. The jet nozzle 10 has a pressure air pipe 12 connected to a pressure air source 17, and a feed pipe 13 including a material inlet 14 connected to a feeder 18 and a coarse particle inlet 15 for introducing coarse particles from the secondary classifier 19 described later, the two inlets 14 and 15 being located in an ejector portion B. An accelerating zone L is provided between the nozzle outlet 11 and the forward end of the pressure air pipe 12 to accelerate the movement of the materials to be treated. An opening 16 is defined in a position of the inner wall surface 6 away from the baffle member 9 to form a coarse particle discharge duct. The opening 16 is connected to the jet nozzle 10 through a conduit 20 which establishes an intercommunicating route between the opening 16 and the nozzle 10. Although the opening 16 is disposed tangentially in this embodiment, it may be disposed otherwise. Number 22 in FIG. 3 denoted screws to provide for vertical adjustment of the upper disc plate 4 constituting a part of the crushing and classifying chamber 2. This adjustment is effective to vary the classified particle sizes by varying the amount and velocity of centripetal air flows within the circulation classifying chamber 2. The two functions of crushing and classifying may be improved by providing a plurality of nozzles 10 and a corresponding number of baffle members 9 in the circulation classifying chamber 2 or by introducing additional pressure air flows into the circulation classifying chamber 2.

How the foregoing apparatus operates will be described hereinafter. The materials delivered from the feeder 18 through the material inlet 14 are carried by high pressure air provided by the pressure air source 17 and jetted out at high velocity through the opening 11 of the nozzle 10. The materials thus jetted out collide with the baffle member 9 disposed in the circulation classifying chamber 2. Since the materials violently collide with the impingement surface 9A of the baffle member 9 after having been accelerated to a sufficient velocity at the accelerating zone L provided in the jet nozzle 10, particles of the materials, especially relatively large particles, are crushed under the impact of the collision. In addition to the crushing action resulting from their collision with the baffle member 9, the particles of the material are subjected to crushing actions resulting from their subsequent collision with the inner wall surface 6 and mutual collision or contact among the particles in the accelerating zone L inside the nozzle 10 and during the circulation inside the circulation classifying chamber 2. Owing to the disposition of the impingement surface 9A of the baffle member 9 somewhat inclined outwardly away from the nozzle 10, the particles rebounding from the impingement surface 9A do not damage the nozzle opening 11 or disturb jet streams J from the nozzle opening 11 but just join circulating streams R running along the inner wall surface 6. Fine particles resulting from these crushing actions are discharged upwardly by way of the fine particle discharge duct 7 disposed at a central top position of the circulation classifying chamber 2 and are transferred to the secondary classifying machine 19. On the other hand, coarse particles in the circulating streams R are partly removed sideways from the opening 16 defined at a position of the inner peripheral wall surface 6 to provide a coarse particle discharge duct, and are blown through the conduit 20 into the nozzle 10 where the coarse particles mix with newly introduced materials coming through the material inlet 14. Then the coarse particles are jetted out again into the circulation classifying chamber 2, together with the newly fed materials, to receive further crushing actions. Fine particles resulting from the repeated crushing actions are discharged by way of the fine particle discharge duct 7 and transferred to the secondary classifying machine 19, as described. The secondary classifying machine 19 separates any coarse particles mixed in with the fine particles and sends them back to the ejector portion B through the coarse particle inlet 15 for further crushing in the circulation classifying chamber 2. The fine particles remaining after the separation are delivered from the secondary classifying machine 19 to the collector 21. The amount withdrawn by way of the opening or coarse particle discharge duct 16 is determined by the area, direction and location of the opening 16. In addition it may be adjusted by means of pressure control within the conduit 20 such as by providing a control valve in the conduit 20.

According to the embodiment as described above, the circulation classifying chamber 2 and the nozzle 10 communicate with each other via the conduit 20, whereby coarse particles in the circulating streams R within the chamber 2 are returned directly to the nozzle 10 without requiring additional means provided outside the apparatus. Thus, the described construction requires only a very short circuit for effecting alternate crushing and classifying repeatedly. Besides, the presence of baffle member 9 greatly improves the crushing efficiency as already described.

Figure 5:
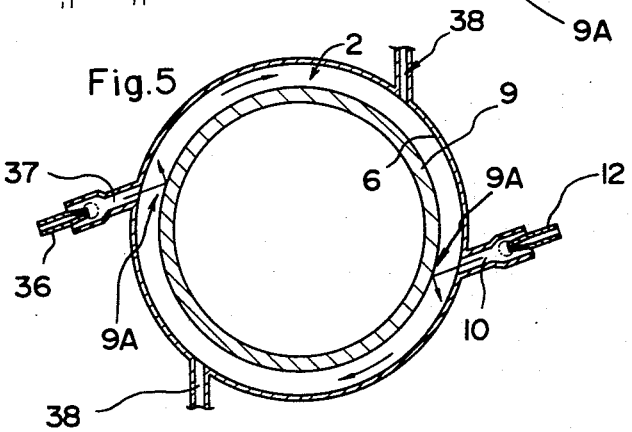
FIG. 5 is a sectional view taken on line V—V of FIG. 4.
Figure 6:
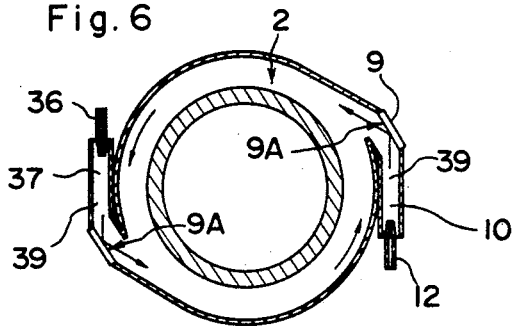
FIG. 6 is a sectional view of a modified example corresponding to the embodiment of FIGS. 4 and 5.

Referring to FIGS. 4–6, the embodiment shown therein comprises the crushing and classifying apparatus 1 and the secondary classifying apparatus 19 of FIG. 1 assembled together and provided with a few additional means. Like numerals are used to describe like components. A first circulation classifying chamber 2 includes a ring-like baffle member 9 defining an annular impingement surface 9A about a circulation axis P, and a conical guide member 8 concentric with and extending from the top of the baffle member 9. A first nozzle 10 receives materials to be treated from a feeder 18 and jets out the materials against the impingement surface 9A by means of high velocity air flows from pressure air pipe 12. The first circulation classifying chamber 2 has a first coarse particle discharge duct 16 at a peripheral position thereof and a first fine particle discharge duct 7 about the circulation axis P. The materials introduced from the first nozzle 10 are crushed by collision against the impingement surface 9A, and the materials rebounding from the impingement surface 9A collide with an inner wall surface 6 of the chamber 2. The crushed materials are classified as they are circulated in the chamber 2, coarse particles and fine particles being withdrawn via the respective discharge ducts 16 and 7. It should be noted that, as shown in FIG. 5, the positional relationship between the impingement surface 9A and the first nozzle 10 is such that the materials rebounding from the impingement surface 9A are given components of velocity in the direction of flow within the first circulation classifying chamber 2, thereby to obtain a desired circulation with good power efficiency.

The first circulation classifying chamber 2 may be provided with means to take in ambient air as necessary to compensate for air flows in the centripetal direction or in the direction of the first fine particle discharge duct 7. In that case ambient air should preferably be introduced in the tangential direction of the inner wall surface or uniformly over the entire periphery by using guide vanes or the like.

A difference between this embodiment and the preceding embodiment is that this embodiment has a second circulation classifying chamber 29 connected substantially concentrically to the first fine particle discharge duct 7. The second circulation classifying chamber 29 contains a vane wheel 30 rotatable to produce circulating flows therein. A second fine particle discharge duct 31 is provided at the top of the chamber 29 about the axis of circulation, and an air classifying chamber 33 is provided below the chamber 29 to take in air flows from a duct or ducts 32 and blow upwardly fine particles of the materials descending from the chamber 29. A second coarse particle discharge duct is connected to a lower position of the air classifying chamber 33 to withdraw coarse particles mixed in the fine particles discharged from the first circulation classifying chamber 2, thereby to improve the classifying precision.

The duct or ducts 32 is/are connected to flow control valve means not shown in the drawings, and may be connected to the top, bottom or any vertically intermediate position of the chamber 33 and may be arranged partly or wholly along the periphery of the chamber 33. The direction in which air is blown from the duct or ducts 32 into the air classifying chamber 33 may be substantially centripetal or substantially tangential of the chamber 33. In other words, it is in accordance with the present invention that the duct or ducts 32 are arranged to produce uniform centripetal air flows and uniform ascending air flows in air classifying chamber 33 to effect a smooth classification of the particles and a smooth withdrawal of coarse particles.

This embodiment further includes an air supply passage 35 for jetting out air flows from around the first fine particle discharge duct 7 toward the second circulation classifying chamber 29 in order to check lowering of the classification precision due to reverse flows of the materials to the first circulation classifying chamber 2. A different air supply passage shown in a dot and dash line 40 in FIG. 4 may be provided instead of the above air supply passage 35.

Another difference between this embodiment and the preceding embodiment is that this embodiment includes a second nozzle 37 adapted to receive coarse particles from the first and second coarse particle discharge ducts 16 and 34 and jet them out against the impingement surface 9A of the baffle member 9 by means of high velocity air flows from a pressure air pipe 36. The provision of the second nozzle 37 assures reduction of the materials under treatment to powdery particles. As shown in FIG. 5 and as in the case of the first nozzle 10, the positional relationship between the impingement surface 9A and the second nozzle 37 is such that the materials rebounding from the impingement surface 9A are given components of velocity in the direction of flow within the first circulation classifying chamber 2 to obtain a desired circulation with good power efficiency.

Other details of the embodiment of FIGS. 4–6 and its modifications are described hereinafter. Number 38 denotes an auxiliary air supply nozzle which is provided as desired to jet out high velocity air flows into the first circulation classifying chamber 2 to promote the circulation therein. The second fine particle discharge duct 31 is connected to a solid-gas separator or a collector.

The impingement surface 9A may comprise surfaces of two of the baffle member 9 such as shown in FIG. 2 opposed to the first and second nozzles 10 and 37, respectively. As shown in FIG. 6, an impingement surface 9A may be provided at a position at which cross each duct 39 adjacent to and communicating with the first circulation classifying chamber 2 and a tangent of the inner wall surface of the chamber 2. It is especially advantageous from the point of view of maintenance and durability to render the ring-like baffle member manually rotatable or rotatable by drive means, to form the impingement surface 9A of a super-hard material or to give hardening treatment to the impingement surface 9A.

A plurality of first nozzles 10 and a plurality of second nozzles 37 may be distributed peripherally of the first circulation classifying chamber 2. Means to feed the materials to be treated to the first and second nozzles 10 and 37 is variable. The gas used for the crushing and classifying purposes is air in most cases, but it may be nitrogen gas or carbon dioxide gas to suit the nature of materials to be treated.

In FIG. 4 pipings shown in dot and dash lines 41 and 42 are connected to the bottoms of the first circulation classifying chamber 2 and the second coarse particle discharge duct 34, respectively. Coarse particles tend to accumulate in the said bottoms under certain conditions, i.e. the nature of materials under treatment or the operating conditions of the crushing and classifying apparatus. The pipings 41 and 42 are used to remove excessive accumulations from these bottoms.

The apparatus of the two described embodiments function better than conventional apparatus for the following reasons: Generally, the conventional apparatus is constructed to feed the materials crushed by the baffle member 9 to the circulation classifying chamber 2 by way of a relatively long air pipe, and therefore the energy imparted to the materials by collision is not effectively used for circulatory classification. This has been one of the main causes of the low treating efficiency in relation to the power required. According to the present invention, the crushed materials are promptly fed to the circulation classifying chamber 2 in order to effectively use the residual energy from the crushing process for the classifying process. Consequently, the present invention provides a gas flow type crushing and classifying apparatus which is compact and efficient for the power required.

More particularly, owing to the described arrangement of the impingement surface 9A, the kinetic energy of the materials rebounding from the impingement surface 9A works directly as the circulating energy for the classifying purposes, and therefore a sufficient flow velocity of the materials is obtained to achieve good classification with little or no promotional supply of pressure gas into the circulation classifying chamber 2. This feature contributes to reduction of both initial and operating costs of the apparatus, which is on the whole therefore excellent from the point of view of efficiency and economy.

The apparatus of FIGS. 4–6 has the following advantages over the apparatus of FIGS. 1–3.

The embodiment of FIGS. 4–6 includes the second circulation classifying chamber 29 and the air classifying chamber 33 in addition to the first circulation classifying chamber 2 to provide a three step classification, wherefore the materials are classified with high precision. The classifying precision is promoted further by the provision of the air supply passage 35 or 40 which assures the transfer of materials from the first circulation classifying chamber 2 to the second circulation classifying chamber 29 and effectively checks the adverse effect due to the reverse flows of the materials. Thus the technical concept of minimizing the size of the apparatus is realized in an ideal manner.

The embodiments shown in FIGS. 7–12 are described hereinafter. The principal portions of these embodiments are the same as those shown in FIGS. 4–6, and the embodiments described henceforth are characterized by rectifiers.

Figure 7:
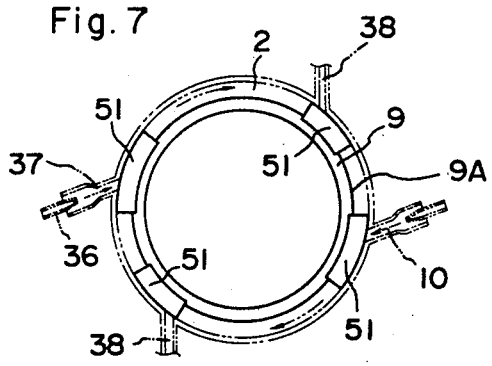
FIG. 7 is a horizontal sectional view of a third embodiment of the present invention.

Referring to FIG. 7 which is a sectional view similar to FIG. 5, the impingement surface 9A has rectifiers 51 at positions opposite the first and second nozzles 10 and 37. The rectifiers 51 are provided for the purpose of promoting the circulation of the materials under treatment within the first circulation classifying chamber 2. The shape of the rectifiers 51 and their positional relationship with the impingement surface 9A are such that the rectifiers 51 are in the form of pent roof for the impingement surface 9A which are attached to the top of the ring-like baffle member 9 and extend entirely or partly and intermittently along the circumference thereof.

Figure 8:
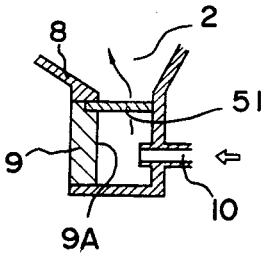
FIG. 8 is an enlarged vertical sectional view of a principal portion of the third embodiment corresponding to the portion of FIG. 4 encircled in a dot and dash line C.
Figure 9:
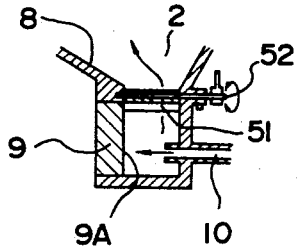
FIGS. 9 through 11 are vertical sectional views showing modified examples of the portion of FIG. 8.
Figure 10:
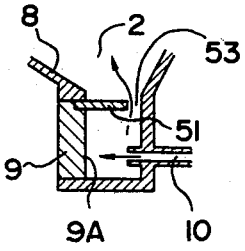

Other shapes and dispositions of the rectifiers 51 are shown in FIGS. 8–10, but they are not limited to these examples. The rectifiers 51 may be arranged in varied ways according to the nature of the materials to be treated and the operating and other conditions.

FIG. 8 shows an embodiment in which rectifiers 51 are disposed locally at positions of the impingement surface 9A of the baffle member 9 which are struck by materials jetting out of the first and second nozzles 10 and 37.

FIG. 9 shows the rectifiers 51 of FIG. 8 supported by a shaft 52 to be angularly adjustable relative to the impingement surface 9A. By varying the angle of inclination of the rectifiers 51, particles rebounding from the impingement surface 9A are efficiently turned into the circulating movement thereby to realize an optimal drive for circulation.

FIG. 10 shows an embodiment in which the rectifier 51 comprises an annular plate having an outer diameter slightly smaller than the inner diameter of the first circulation classifying chamber 2, the resulting circumferential space serving as a flow passage 53.

As described above, the rectifiers 51 are effective to prevent the rebounds of the materials from the impingement surface 9A from flowing directly into the first circulation classifying chamber 2 and to efficiently convert the kinetic energy imparted by the first and second nozzles 10 and 37 into components in the circulating direction, thereby to improve the classifying efficiency.

Figure 11:
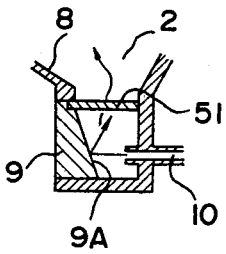

The rectifiers 51 as described are provided for the purpose of converting the rebounding components into circulating components to effectively use them for good circulation classifying within the first circulation classifying chamber 2. On the other hand, the rectifiers 51 also function as second crusher surfaces for the materials rebounding from the impingement surface 9A, and therefore require consideration as to their material and other aspects similar to the impingement surface 9A. The impingement surface 9A may be modified to advantage considering the presence of the rectifiers 51. As shown in FIG. 11, for example, the impingement surface 9A per se may be inclined relative to the rectifiers 51, whereby the materials jetting out of the first and second nozzles 10 and 37 are positively turned against the recitifiers 51 for an increased frequency of crushing impact.

Figure 12:
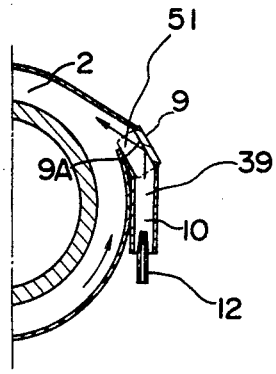
FIG. 12 is a view showing how a rectifier is mounted in the apparatus of FIG. 6.

The baffle members 9 of FIG. 6 may of course be provided with the described rectifiers 51, as illustrated in FIG. 12.

Furthermore, it is to be understood that the rectifiers 51 are applicable also to the crushing and classifying apparatus of FIGS. 1–3. The effect produced in this instance is of course the same as the one already described.

In summary, the gas flow type crushing and classifying apparatus according to this embodiment is characterized by the rectifiers 51 attached to the impingement surface 9A to improve the working efficiency of the circulation classifying chamber 2 including the baffle member 9 by preventing the rebounding materials from flowing directly into the circulation classifying chamber 2 and by converting them into the circulating components in the direction of flow in the chamber 2.

What is claimed is:

1. A gas flow type crushing and classifying apparatus comprising a first circulation classifying chamber including a first coarse particle discharge duct connected to a peripheral portion thereof and a first fine particle discharge duct connected to the chamber about an axis of circulation, baffle means disposed in said first circulation classifying chamber to be peripherally impinged upon by materials under treatment which are jetted out on high velocity gas flows from at least one nozzle such that said materials rebounding from said baffle means have components of velocity in a circulating direction within said first circulation classifying chamber, a second circulation classifying chamber connected directly to the top of said first circulation classifying chamber to be substantially coaxial therewith and substantially concentric with said first fine particle discharge duct, said circulation chamber including a second fine particle discharge duct substantially coaxial with said first fine particle discharge duct, a vane wheel mounted in said second circulation classifying chamber, spaces between adjacent pairs of vanes being in communication with said second fine particle discharge duct, and a gas classifying chamber interposed between said first and second circulation classifying chambers for blowing upwardly fine particles of the materials descending from said second circulation classifying chamber, said gas classifying chamber including a second coarse particle discharge duct connected to a peripheral portion thereof.

2. A gas flow type crushing and classifying apparatus according to claim 1 in which:

said baffle means comprises a rotatable ring.

3. A gas flow type crushing and classifying apparatus according to claim 2 further comprising a gas supply passage for jetting out gas flows from adjacent said first fine particle discharge duct toward said second fine particle discharge duct.

4. A gas flow type crushing and classifying apparatus according to claim 3 further comprising substantially horizontal rectifier means provided at a top portion of said baffle means, whereby the materials rebounding from said baffle means are given components of velocity in a circulating direction.

5. A gas flow type crushing and classifying apparatus according to claim 4, in which:

a second nozzle is provided to receive coarse particles from said first and second coarse particle discharge ducts and to jet out the coarse particles against said baffle means, the coarse particles rebounding from said baffle means being given components of velocity in the circulating direction.

6. A gas flow type crushing and classifying apparatus according to claim 3, in which:

a second nozzle is provided to receive coarse particles from said first and second coarse particle discharge ducts and to jet out the coarse particles against said baffle means, the coarse particles rebounding from said baffle means being given components of velocity in the circulating direction.

7. A gas flow type crushing and classifying apparatus according to claim 1, in which:

a second nozzle is provided to receive coarse particles from said first and second coarse particle discharge ducts and to jet out the coarse particles against said baffle means, the coarse particles rebounding from said baffle means being given components of velocity in the circulating direction.

* * * * *